United States Patent [19]

McKeighen

[11] 3,969,155

[45] July 13, 1976

[54] PRODUCTION OF TAPERED TITANIUM ALLOY TUBE

[75] Inventor: James F. McKeighen, Huntington Beach, Calif.

[73] Assignee: Kawecki Berylco Industries, Inc., Reading, Pa.

[22] Filed: Apr. 8, 1975

[21] Appl. No.: 566,141

[52] U.S. Cl. ..... 148/11.5 F; 29/DIG. 45; 29/180 GC; 72/38; 72/364; 72/700; 148/12.7

[51] Int. Cl.[2] ..... C21D 1/74; C21D 1/80; C21D 9/08; C22F 1/18

[58] Field of Search ..... 29/DIG. 25, DIG. 45, 29/180 GC; 72/38, 76, 276, 342, 364, 367, 402, 700; 148/11.5 F, 12.7 B; 273/80 R, 80.2

[56] References Cited

UNITED STATES PATENTS

| | | | |
|---|---|---|---|
| 1,573,708 | 2/1926 | Hoerle | 29/180 GC |
| 2,001,643 | 5/1935 | Wilcox | 29/180 GC |
| 2,037,636 | 4/1936 | Lagerblade | 29/180 GC |
| 2,804,409 | 8/1957 | Kessler et al. | 148/11.5 F |
| 2,857,269 | 10/1958 | Vordahl | 148/12.7 |
| 2,974,076 | 3/1961 | Vordahl | 148/12.7 |
| 3,614,101 | 10/1971 | Hunter | 273/80 B |
| 3,649,374 | 3/1972 | Chalk | 148/11.5 F |
| 3,794,528 | 2/1974 | Rosales et al. | 148/12.7 |
| 3,809,403 | 5/1974 | Hunter | 273/80 B |

*Primary Examiner*—C. W. Lanham
*Assistant Examiner*—E. M. Combs
*Attorney, Agent, or Firm*—Kolisch, Hartwell, Dickinson & Stuart

[57] ABSTRACT

Production of tapered titanium alloy tube performed by subjecting uniformly dimensioned tube to multiple swaging steps interspersed with vacuum annealing, heat hardening in the presence of atmospheric gases producing high yield strength in the final product.

6 Claims, 1 Drawing Figure

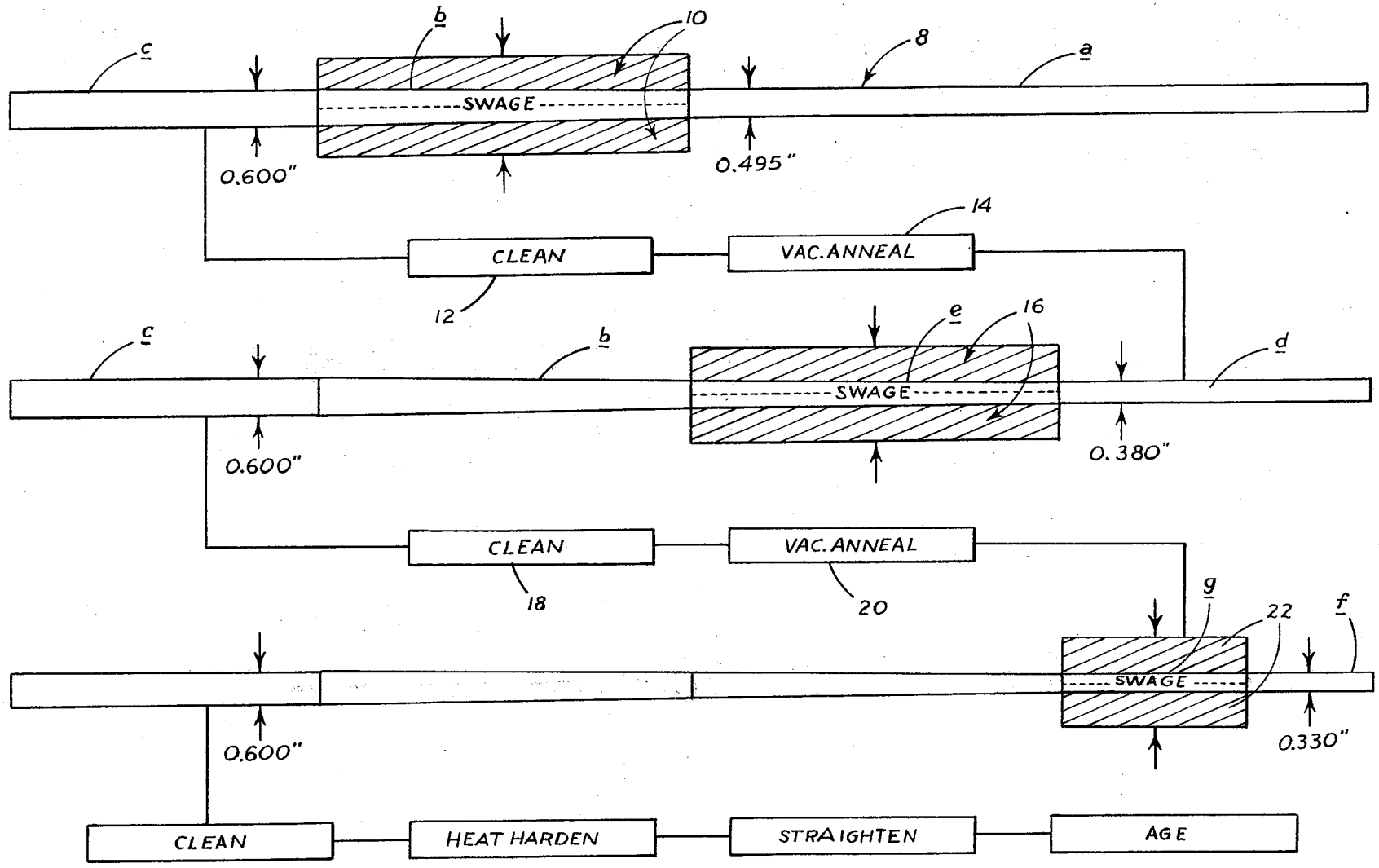
a
8
0.495"
10
SWAGE
b
0.600"
c
14
VAC. ANNEAL
CLEAN
12
d
0.380"
16
e
SWAGE
b
0.600"
c
VAC. ANNEAL
20
CLEAN
18
f
0.330"
22
g
SWAGE
0.600"
AGE
STRAIGHTEN
HEAT HARDEN
CLEAN

PRODUCTION OF TAPERED TITANIUM ALLOY TUBE

This invention relates to the manufacture of a length of tapered titanium alloy tube. More particularly, the invention concerns a method of processing a length of titanium alloy tube having substantially uniform diameter to obtain a tapered product therefrom, as well as tubular products producible using the method.

Titanium base alloys are important structural materials by reason of the strength to weight ratios attainable using such materials. Such alloys, however, present special problems in making tapered tubular products therefrom. These arise by reason of the change in mechanical properties which are produced in a titanium alloy when the material is worked as part of the operation to produce a tapered profile in a tube, difficulties in cold working such alloys to obtain more than a limited amount of a tapered profile in a tube made of the alloys, the reactivity of such alloys with constituents in the air at elevated temperatures, the complexities of the equipment needed to process the alloy, etc.

A general object of the invention is to provide a novel method of processing a length of titanium alloy tube to obtain a product having a taper over at least a portion of its length, wherein the product produced has exceptionally high yield strength, and where such yield strength is present throughout the length of the tapered product.

Another object of the invention is to provide such a method which is capable of being performed using a swaging machine to provide the taper desired, such a machine being relatively inexpensive as compared to equipment such as a tube reducer and being conveniently suited for producing a taper extending over a relatively long expanse of tube.

A further object of the invention is to provide a method of manufacturing a tapered titanium alloy tube which includes multiple swaging steps performed on a length of tube to introduce the taper, interspersed with vacuum annealing effective to introduce ductility to that part of the tube which has been work hardened by the previously performed swaging step, in combination with a unique heat hardening of the length of tube after the taper has been introduced effective to impart a high yield strength to the final product which is present throughout the length of the product.

The invention has particular utility in connection with the manufacture of tapered tubular products such as golf club shafts, wherein ordinarily it is desirable to have essentially a uniform taper extending over an appreciable expanse of the shaft, and that the shaft have a high yield strength throughout its length. It has been found that titanium alloy shafts are producible in accordance with the invention which have the necessary yield strength to inhibit permanent bending in the shaft under playing conditions, the shafts not possessing the bulky characteristics of conventional aluminum shafts, being considerably lighter than conventional steel shafts, and possessing exceptionally good resistance to torque, as compared to composite shafts having relatively low torque resistance.

These and various other objects and advantages of the invention will become more fully apparent as the following description is read in conjunction with the accompanying drawing, which is a schematic flow diagram illustrating the production of a tapered titanium alloy tube, more particularly a golf club shaft, as contemplated herein.

A number of titanium alloys have been commercially developed, including the so-called beta alloys and alpha-beta alloys. Many of these have strength properties exceeding those obtainable with commercially pure titanium. Two common alloys which are commercially available comprise so-called 6–4 alloy (Ti — 6Al — 4V) and so-called 3–2.5 alloy (Ti — 2.5 to 3.5Al — 2 to 3V). The latter alloy is readily commercially available in seamless tubing form, and has properties rendering it susceptible to being cold worked relatively easily, and has been discovered to produce a superior golf club shaft when processed as contemplated herein.

A seamless length of titanium alloy tube of the type above described may be cold worked to introduce a taper into the tube, and in producing such a taper the use of a swaging machine is a preferred instrumentality. A typical shaft may have a length in excess of 40 inches, with the tapered portion of this shaft extending over an expanse of the shaft some 30 inches in length. Swaging apparatus can be employed to produce a taper over such a length, whereas a tube reducer or similar machine would have to be extensively modified from a conventional form to render it suitable for performing such an operation. Problems of lubricity make use of a die in the processing of a titanium alloy unsuitable.

When swaging a length of tube to produce a taper therein, such as a seamless titanium alloy tube as above described, there is a limit to the amount of taper which may be produced in any single swaging step, by reason of the cold working and resultant hardening which takes place in the alloy during the swaging. If such limit is exceeded internal cracking results.

A tapered tube, as characterizes a golf club shaft, may be made utilizing multiple swaging steps, interspersed with a vacuum annealing to restore ductility to the tube being worked upon, with the amount of diameter reduction occurring in each swaging step maintained within the limit permitted to inhibit any internal cracking or other destruction. If the last vacuum annealing to which the tube is subjected is the one performed prior to the final swaging step, a product is produced which has been work hardened throughout that portion of the tube which has been worked upon in the last swaging. However, this leaves an expanse of the length of the tube, for instance, that part of the tube length which is to serve as the handle in the shaft, which has not been cold worked during the final swaging step, and which, therefore, is in the annealed state prepared in the tube length before the last performed swaging step occurred. As a consequence, the work hardened condition produced by the last performed swaging step does not exist throughout the length of the tube, and the yield strength resulting from work hardening is not shared by all parts of the tube length.

In attempting to form a titanium alloy golf shaft by conventional swaging techniques using intermittent annealing cycles to obtain suitable ductility for a subsequent swaging operation, it was discovered that while the strength level in the smaller diameter part of the shaft was raised to an acceptable level, the strength in the larger diameter, or handle, end of the shaft was of necessity reduced to a typical annealed condition level. This disparity in the mechanical properties from one end of the shaft to the other was found to be unacceptable, since under conditions of extreme usage, the shaft would occasionally take a permanent set in areas of lower strength level.

Because of the tendency of titanium alloys to absorb oxygen and nitrogen which can cause embrittlement unless heat treat cycles are done in a vacuum or under a controlled atmosphere, the standard aircraft and aerospace specifications are strictly predicated on carefully controlled conditions. It has been found, however, that by subjecting a tapered shaft to an elevated temperature in a normal atmosphere followed by rapid quenching, oxygen pickup which would be considered deleterious to an aerospace type product in fact enhanced the mechanical properties of a tubular product, such as a golf shaft, by enabling the attaining of a yield strength beyond 130,000 pounds per square inch throughout the length of the shaft.

As contemplated by the instant invention, a length of seamless titanium alloy tube of substantially uniform diameter is converted into a tapered article such as a gold club shaft through multiple swaging steps performed over an expanse of said length of tube. Between successive swaging steps, the tube length is vacuum annealed to introduce ductility to that part of the tube which has just been work hardened by the previously performed swaging step. The tube length after the last performed swaging step has the desired tapered profile, but possesses a yield strength which exhibits considerable variation in regions distributed along the tube length. Thus and in the case of a 3–2.5 titanium alloy, that part of the tube length which has been cold worked by the last swaging may exhibit a yield strength ranging from 100,000 to 120,000 lbs. per inch square, whereas that part of the tube length which was not cold worked by the last performed swaging step may exhibit a yield strength in the range of 75,000 to 85,000 lbs. per inch square.

After the last performed swaging step, the profiled length of tube is heat hardened, i.e., heated to an elevated temperature, with such heating being followed with rapid cooling through quenching as in water. The heat hardening introduces a higher yield strength than possessed formerly by the work hardened expanse of the tube length and this heat hardening and high yield strength is present throughout the entire length of the profile tube.

The heat hardening is performed under atmospheric conditions. As a consequence, oxygen and to a limited extent nitrogen present in air react with the titanium alloy at the elevated temperature involved to form compounds therewith. These materials, ordinarily thought of as contaminants in conventional manufacture, are found to introduce optimum yield strength to the final product. Ordinarily, the amount of oxygen picked up through the hardening process is limited to about 0.4% by weight, and the amount of nitrogen to about 0.04%.

Utilizing the approach of the invention, different lengths of tube suitable for shafts may be produced exhibiting a yield strength in the range of 120,000 to 150,000 lbs. per square inch, which yield strength exists throughout the length of the tube. The product retains a limited amount of ductility, i.e., from about 1% to 4% elongation. The modulus of elasticity is relatively high, in a typical shaft exceeding about 15 million lbs. per square inch.

Describing now the manufacture of a golf shaft, a seamless, titanium alloy (3–2.5) tube of uniform diameter, having a length of 44 inches, was selected for processing. The tube selected had an O.D. of 0.600 inch, and a wall thickness of 0.019 inch. The tube selected was in a fully annealed, i.e., ductile state.

As an initial step in preparing a tapered profile in the tube, the tube length was swaged at room temperature using a conventional swaging machine having opposed complementing swaging parts rapidly pounded against each other, with the tube rotated and moved axially therebetween, to cold work the tube. Swaging reduced the diameter of the length of tube over an end expanse having uniform diameter, to 0.495 inch, and produced an expanse in the tube length joining with this expanse of uniform diameter having a tapered profile, where the diameter of the tube length tapered from 0.600 inch to 0.495 inch. Left at one end of the length of tube was an expanse having the original 0.600 inch diameter, of 10 inch length, this latter expanse serving as the handle in the golf club shaft.

In the drawing, the length of tube being processed is indicated at 8, and the swaging elements used in this first swaging step at 10. The 0.495 inch diameter expanse is indicated at *a*, the tapered expanse at *b*, and the 10 inch handle expanse at *c*.

After swaging, the tube length was subjected to a cleaning operation, comprising cleaning and rinsing, pickling (employing a nitric acid and hydrochloric acid mixture) rinsing, and subsequent drying. The tube length subsequently was annealed, by heating to 1275°F. in a vacuum (or inert atmosphere), for a period of 2 hours. After annealing, the tube length was blasted, cleaned and dried, to prepare the tube length for a subsequent swaging step. In the drawing, the cleaning operation is indicated by the block 12, and the vacuum annealing operation by the block 14.

The tube length as profiled by the first swaging step was then subjected to another swaging step, utilizing swaging parts 16, with this swaging step being operable to rework expanse *a*, and to produce in the length of tube an end expanse having a uniform diameter of 0.380 inch, and an expanse joining with this end expanse of tapered profile, varying in diameter from 0.380 inch to 0.495 inch (as produced by the initial swaging step). The tube length after swaging included its tapered expanse *b* and its expanse *c* of uniform diameter produced as the result of the first swaging step. In the drawing, the expanse of uniform 0.380 inch diameter is shown at *d*, and the tapered expanse joining with expanse *d* is shown at *e*. The tube length as so processed was cleaned and vacuum annealed, with annealing followed by blasting, cleaning and drying, in a manner similar to the processing performed on the tube length after the first swaging step, to prepare the tube length for a final swaging step. The cleaning operation and vacuum annealing operations are represented by the blocks indicated at 18 and 20 in the drawing.

The length of tube as so processed was subjected to a final swaging step utilizing swaging parts 22, with reworking of expanse *d*. The tube length as finally profiled included an expanse *f* at the tip end of the shaft of uniform diameter (0.330 inch) having a length of 4 inches. Joining with this expanse was an expanse *g* of tapered profile, ranging in diameter from 0.330 inch to 0.380 inch (as produced by the second swaging step). The remainder of the tube length had the profile produced by the first and second swaging steps.

The various swaging steps did not materially increase the length of the tube, but had the effect of increasing the wall thickness of the tube from the 0.019 inch thickness of the original tube. Thus, the wall thickness of the tube length at its reduced diameter end (the tip end of 0.330 inch diameter) was determined to be 0.030 inch.

After the final swaging step, the tube length was subjected to a cleaning operation by subjecting it to a washing and rinsing followed by pickling and rinsing, followed by drying. The dried tube length was then heat hardened by heating at a temperature of 1650°F. for a period of 30 minutes, in the atmosphere, with such heating being followed by rapid cooling, by subjecting the tube length to a water quench. The heating temperature indicated is slightly below the beta transus temperature of the alloy, and this temperature was selected, as well as the heat treatment period of 30 minutes (ordinarily no more than about 45 minutes), for the purpose of controlling the amount of oxygen and nitrogen picked up by the tube length during the heat hardening operation. In a typical manufacture, the amount of oxygen picked up is in the neighborhood of 0.25% and the amount of nitrogen picked up in the neighborhood of 0.02%.

After the heat hardening step, the tube length was straightened, which may be performed manually, or with a straightener machine. Straightening was followed with a 4-hour aging period, comprising heating the tube at reduced temperture, namely 950°F., either in an atmosphere or vacuum. The straightening is performed to remove any permanent bend or other deformation which may be introduced by the quenching which is included in the heat hardening step. Mechanical straightening has been noted in some instances somewhat to reduce the yield strength of the product, and as a consequence, the aging might preferably be performed as the final treatment in the preparation of the final tapered tubular product. However, straightening may be performed after aging where such is indicated.

Polishing and trimming of the tube length concludes the manufacture of the shaft.

A golf club shaft prepared as above exhibited a yield strength of 136,000 lbs. per square inch which existed throughout the length of the shaft. Ductility as measured in percent elongation was 3%. Modulus of elasticity was 16 million lbs. per square inch.

A golf club shaft as so produced exhibits exceptional torque resistance, which is reflected in inhibition of a tendency for the head of the club to turn as the club is swung into and through the ball during the completion of the golf swing. By reason of the titanium alloy composition, the shaft is relatively light, enabling the golfer to swing with greater speed, which is reflected in turn in greater distance when hitting the ball. The strength of the shaft is such that, unlike aluminum shafts, the shaft may be manufactured with a pleasingly tapered appearance and without the massive characteristic of conventional aluminum shafts.

It is claimed and desired to be secured by Letters Patent:

1. In the manufacture of a length of tapered, alpha beta titanium alloy tube, the method comprising shaping by cold working part of a length of a cylindrically shaped tube which is in an annealed state to produce a tapered portion in the length of tube with work hardening of said portion, and to leave a remainder portion in said length of tube substantially unworked and in an annealed state, and heat hardening the length of tube including said tapered portion and said remainder portion of said length of tube by heating said portions at an elevated temperature which is below the beta transus temperature with rapid quenching following said heating, said heating during heat hardening being performed under noncarbonaceous conditions where atmospheric gases are present with the absorption of up to about 0.4% by weight oxygen, said heat hardening producing an increased yield strength throughout the entire length of the tube which yield strength is substantially uniform.

2. In the manufacture of a length of tapered alpha beta titanium alloy tube, the method comprising cold working by swaging a length of tube to produce an expanse of uniform diameter over a portion of the length of the tube which diameter is less than the original diameter of the tube and also to produce an expanse of tapered profile joining with said expanse of uniform diameter, said expanses being work hardened by the swaging, annealing the entire tube length including said expanse of uniform diameter and said expanse of tapered profile in an inert environment to reintroduce into said expanses ductility removed by the swaging, cold working by swaging only the expanse of the tube length having uniform diameter to produce in at least a part of said expanse a portion of tapered profile which has been work hardened by the cold working, portions of the tube length not cold worked remaining in an annealed state, and after the last performed swaging heat hardening the entire tube length including portions in an annealed state and in a work hardened state, said heat hardening being done by heating the entire tube length at an elevated temperature which is below the beta transus temperature of the alloy and in the presence of atmospheric gases and under noncarbonaceous conditions with the absorption of up to 0.4% by weight oxygen and such heating being followed in the heat hardening by rapid quenching, said heat hardening producing an increased yield strength throughout the entire tube length, which yield strength is substantially uniform.

3. The method of claim 2, wherein the titanium alloy is a 3–2.5 titanium, aluminum, vanadium alloy, heat hardening is done at a temperature of approximately 1650°F., and after heat hardening the tube is subjected to aging by heating at a temperature of approximately 950°F.

4. A hollow titanium alloy shaft produced by the method of claim 2.

5. In the manufacture of a length of tapered, alpha beta titanium alloy tube, the method comprising cold working by swaging a cylindrically shaped tube which is in an annealed state, said swaging of the tube extending from one end of the tube and terminating short of the other end of the tube to leave a portion of the tube at said other end in its original annealed state and having original diameter and to produce in the remainder of the tube a work hardened state and a diameter which is less than the diameter prior to cold working including a taper, annealing under inert conditions the entire tube length, cold working by swaging at least a part of and only said remainder of the tube again to leave said portion of the tube at said other end in its annealed state and having original diameter and to produce in said part of the remainder of the tube where such has been cold worked a work hardened state and a diameter which is less than the diameter prior to cold working including a taper, and after the last performed swaging heat hardening the entire tube including said portion of the tube at said other end in its annealed state and said part of the remainder of the tube which has been work hardened by cold working, said heat hardening being done by heating under noncarbonaceous conditions the tube throughout its length at an elevated temperature which is below the beta transus temperature of the alloy with rapid quenching following said heating to rapidly cool the tube throughout its length, said heat hardening producing an increased yield strength throughout the entire length of the tube, which yield strength is substantially uniform.

6. A hollow titanium alloy shaft produced by the method of claim 5.

* * * * *